US005896813A

United States Patent [19]

Nikulainen et al.

[11] Patent Number: 5,896,813

[45] Date of Patent: Apr. 27, 1999

[54] GRADIENT CALENDER

[75] Inventors: Osmo Nikulainen, Muurame; Ari Lehto, Leppävesi, both of Finland

[73] Assignee: Valmet Corporation, Helsinki, Finland

[21] Appl. No.: 08/602,752

[22] PCT Filed: Jun. 15, 1995

[86] PCT No.: PCT/FI95/00348

§ 371 Date: Feb. 13, 1996

§ 102(e) Date: Feb. 13, 1996

[87] PCT Pub. No.: WO95/34714

PCT Pub. Date: Dec. 21, 1995

[30] Foreign Application Priority Data

Jun. 15, 1994 [FI] Finland ..... 942833

[51] Int. Cl.[6] ..... D21G 1/00; B30B 3/04

[52] U.S. Cl. ..... 100/335; 100/153; 100/160; 100/162 B; 162/206; 162/358.5

[58] Field of Search ..... 100/38, 93 RP, 100/153, 160, 162 R, 162 B, 302, 305, 306, 335, 336; 162/206, 358.1, 358.2, 358.5, 361

[56] References Cited

U.S. PATENT DOCUMENTS

| | | | |
|---|---|---|---|
| 2,908,964 | 10/1959 | Appenzeller | 100/93 RP |
| 4,497,246 | 2/1985 | Pav et al. | 100/162 R |
| 4,605,366 | 8/1986 | Lehmann et al. | 100/93 RP |
| 4,614,565 | 9/1986 | Riihinen | 162/206 |
| 4,653,395 | 3/1987 | Verkasalo | 100/38 |
| 4,903,517 | 2/1990 | Van Haag et al. | 100/162 B |
| 4,945,654 | 8/1990 | Mason | 100/93 RP |
| 5,171,404 | 12/1992 | Ellis et al. . | |
| 5,251,551 | 10/1993 | Abe et al. | 100/162 R |
| 5,400,707 | 3/1995 | Neider et al. | 100/162 R |
| 5,438,920 | 8/1995 | Koivukunnas et al. | 100/162 B |

FOREIGN PATENT DOCUMENTS

| | | | |
|---|---|---|---|
| 0661405 | 7/1995 | European Pat. Off. . | |
| 940050 | 1/1994 | Finland . | |
| 2169381 | 7/1986 | United Kingdom | 162/358.1 |
| 95/14813 | 6/1995 | WIPO . | |

OTHER PUBLICATIONS

"Thermal Bonding Utilizing Calenders", D. Steve Gunter, Nonwovens Bonding, TAPPI Journal, Jun., 1994, pp. 216–224.

*Primary Examiner*—Stephen F. Gerrity
*Attorney, Agent, or Firm*—Steinberg & Raskin, P.C.

[57] ABSTRACT

A gradient calender including two calender rolls arranged to form a calendering nip, at least one of the rolls being a hard-faced calender roll which is heatable to a high temperature whereby a web is passed through the calendering nip for hot calendering the web. At least one of the calender rolls is arranged to be loaded toward the calendering nip by a respective variable-crown support roll so that an auxiliary nip between the support roll and the respective calender roll and the calendering nip are in a common nip plane. Deflection of the calendering nip and the calender rolls is substantially prevented by the effect of the load produced by hydraulic loading devices arranged in the support roll.

6 Claims, 4 Drawing Sheets

GRADIENT CALENDER

FIELD OF THE INVENTION

The invention concerns a gradient calender, comprising two calender rolls which form a calendering nip between them, of which calender rolls at least one roll is a hard-faced calender roll which can be heated to a high temperature, the paper web or equivalent being passed through the calendering nip for hot calendering of the web.

BACKGROUND OF THE INVENTION

By means of calendering of paper, attempts are made to apply an improving effect to smoothness, glaze and surface properties of paper. The calendering temperature has a significant effect on the properties of paper so that, for example, if it is desirable to keep the smoothness that has been achieved invariable, by raising the temperature it is possible to lower the linear load that is used. On the other hand, if it is desirable to keep the linear load unchanged, the smoothness of the paper can be improved by raising the calendering temperature. This is why, in paper machines, paper is hot-calendered, for example, by means of a what is called gradient calender. Thus, today a gradient calender comprises two heatable rolls that form a nip with one another, the paper web being passed through the calendering nip between said rolls. It is a problem of the present solutions that at least one of the heatable rolls that form the calendering nip must be a variable-crown roll in order that the desired uniform linear load could be obtained in the calendering nip. However, making a variable-crown roll into a hot roll is highly expensive, and especially when surface temperatures of an order of 200° C. and higher are required from calender rolls, the limits of the present-day technology constitute an obstacle. In the light of the prior-art knowledge, the service lives of hydraulic fluids and of hydraulic components in general become decisively shorter when the temperature of the fluid exceeds 200° C. At the same time, the cost of operation of the system becomes unduly high. These problems are manifested in particular in connection with a heatable variable-crown roll. It is a second factor which increases the costs significantly that in the prior-art calenders the diameters of the calender rolls must be quite large in order that the construction could be made robust enough.

OBJECTS AND SUMMARY OF THE INVENTION

The object of the present invention is to provide a gradient calender of a novel type which provides a significant improvement over the prior art and by whose means most of the drawbacks related to the prior-art solutions are avoided. In view of achieving this, the gradient calender in accordance with the invention is mainly characterized in that at least one of the calender rolls is arranged to be loaded towards the calendering nip by means of a variable-crown support roll so that the auxiliary nip between said support roll and the corresponding calender roll forms a common nip plane with the calendering nip, deflection of the calendering nip and of the calender rolls, respectively, being substantially prevented by the effect of the load produced by means of the hydraulic loading means in the support roll/rolls.

By means of the invention, a number of remarkable advantages are obtained over the prior art, of which advantages some of the most important ones will be described in the following. Even if the construction of the gradient calender in accordance with the present invention is more complicated than in the prior art, the servicing and maintenance of the system is, nevertheless, considerably simpler and easier. The cost of operation of a gradient calender in accordance with the present invention is substantially lower than in the prior art. The variable-crown rolls that are used in the calender in accordance with the present invention are at a normal temperature, so that the problems of components related to the prior art are eliminated. Nor does the solution in accordance with the invention involve sealing problems similar to those in the prior-art solutions, because in the present invention none of the rolls that form the calendering nip has to be formed into a variable-crown roll. Thus, in the rolls that form the calendering nip, it is unnecessary to use the hydraulic and lubrication fluids required by variable-crown rolls, but in said rolls exclusively heat-transfer fluids are used, which tolerate heat considerably better than said hydraulic and lubricating fluids do. Further, in a calender in accordance with the present invention, it is possible to use components that have been tested earlier, so that the risks related to reliability in operation are substantially little. In the case of a soft calendering nip, in the present invention, a heatable roll of smaller diameter can be used. In spite of the complicated construction, the cost of acquisition of the calender in accordance with the invention is competitive with the prior-art constructions, for, even though, in the calender of the present invention, a higher number of rolls is employed than in the prior art, these rolls are essentially smaller than the prior-art calender rolls. The further advantages and characteristic features of the invention will come out from the following detailed description of the invention.

BRIEF DESCRIPTION OF THE DRAWINGS

In the following, the invention will be described by way of example with reference to the figures in the accompanying drawing.

DETAILED DESCRIPTION OF THE PREFERRED EMBODIMENTS

Figure 1B:
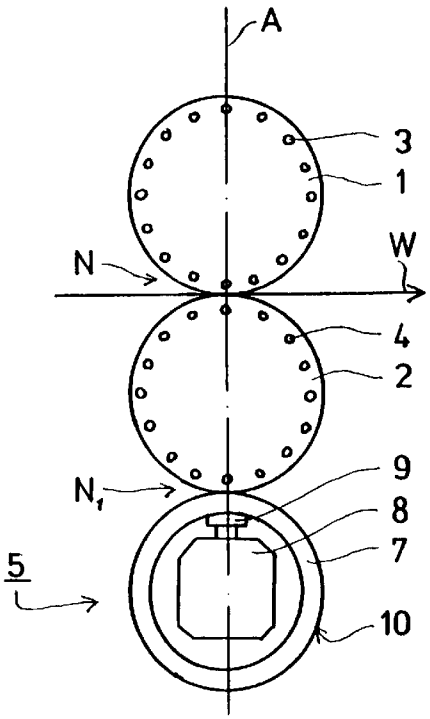
FIG. 1B is an illustration corresponding to FIG. 1A of a modification of a calender as shown in FIG. 1A.

In the figures in the drawing, the paper web W is passed through the calendering nip N, which is formed between two heatable, hard-faced calender rolls 1,2. In the exemplifying embodiments shown in the figures, the calender rolls 1,2 are so-called "drilled" rolls, into which bores 3,4 have been formed in the vicinity of the roll faces, in which bores a heating medium, such as a heat-transfer fluid, is arranged to circulate so as to heat the roll face to the desired calendering temperature. Differing from the illustrations in the figures, as the calender rolls 1,2, it is also possible to use such heatable rolls in which a displacement piece is fitted inside the tubular roll mantle so that an annular space remains between said displacement piece and the roll mantle, in which space the heating medium is arranged to circulate. Thus, none of the calender rolls 1,2 is a variable-crown roll, but the rolls are simply heatable rolls whose surface temperatures can be raised by means of the heating medium even up to a temperature higher than 200° C. The linear load in the calendering nip N is typically 200 kN per meter or lower than that.

Figure 1A:
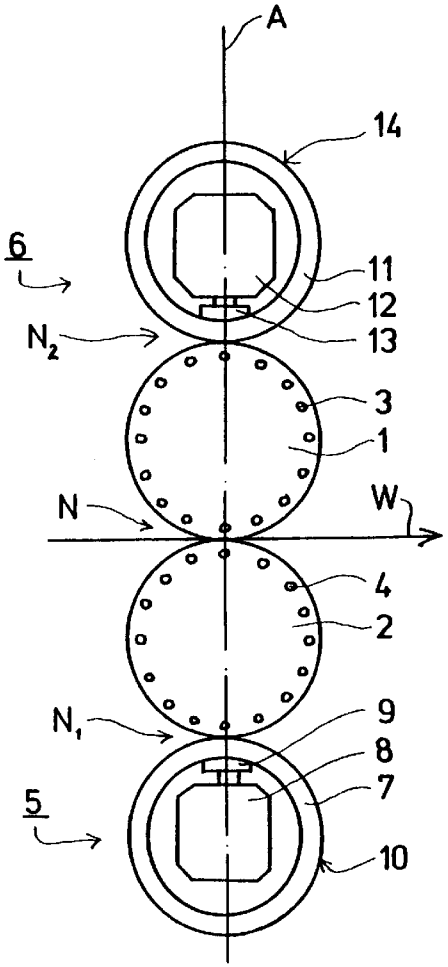
FIG. 1A is a fully schematic side view of a first embodiment of a gradient calender in accordance with the invention.

In the exemplifying embodiment shown in FIG. 1A, the calender is additionally provided with two support rolls 5,6, which support both of the calender rolls 1,2, so that said support rolls 5,6 are arranged in a nip plane A common with the calender rolls 1,2. Thus, the support rolls 5,6 form auxiliary nips $N_1$,$N_2$ with the calender rolls 1,2. The support rolls 5,6 are hydraulically loaded variable-crown rolls, which comprise a tubular roll mantle 7,11, which is arranged revolving on the roll axle 8,12. In the axle 8,12 of the support rolls, hydraulic loading means 9,13 are fitted, which are supported by the effect of a pressure medium against the inner face of the roll mantle 7,11 substantially at the common nip plane A. By means of the variable-crown support rolls 5,6, the profile of the nip N is not regulated, but by means of said rolls exclusively the desired level of linear load is produced and maintained in the calendering nip N. Moreover, by means of the variable-crown support rolls 5,6, deflection of the heatable calender rolls 1,2 is prevented by means of the hydraulic loading means 9,13.

FIG. 1B shows a modification of the calender as shown in FIG. 1A, and the solution shown in FIG. 1B differs from that shown in FIG. 1A in the respect that, in this embodiment, just one of the calender rolls 1,2 is provided with a support roll 5. The solution of FIG. 1B can be used favorably in particular in cases in which the linear loads in the calendering nip N are relatively low, for example of an order of 100–150 kN/m. In such a case, a variable-crown support roll 5 is needed at the side of one calender roll 2 only, by means of which support roll 5 the calendering nip N is kept straight. Since the support rolls 5,6 are in direct nip contact with the calendering rolls 1,2 in the embodiments of FIGS. 1A and 1B, it is an essential feature of the solution that the surface material 10,14 of the roll mantles of the variable-crown support rolls 5,6 is substantially softer than the faces of the calender rolls 1,2. It is a further essential feature of the surface material 10,14 of the support rolls that the material must withstand relatively high temperatures, because the calender rolls 1,2 are hot. As the surface material 10,14 of the roll mantles of the support rolls, it is possible to use, for example, a bronze, white-metal or ceramic coating or some heat-resistant hard rubber-like coating, for example a heat-resistant polymer, which does not damage the surface of the heatable calender roll 1,2.

Figure 2B:
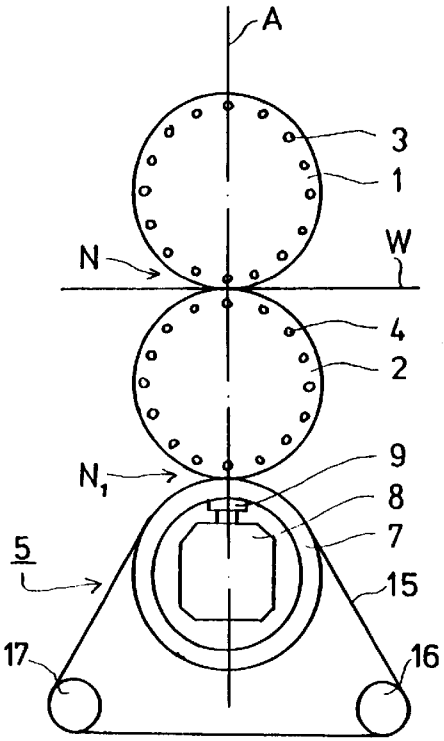
FIG. 2B shows a modification of a calender as shown in FIG. 2A.
Figure 2A:
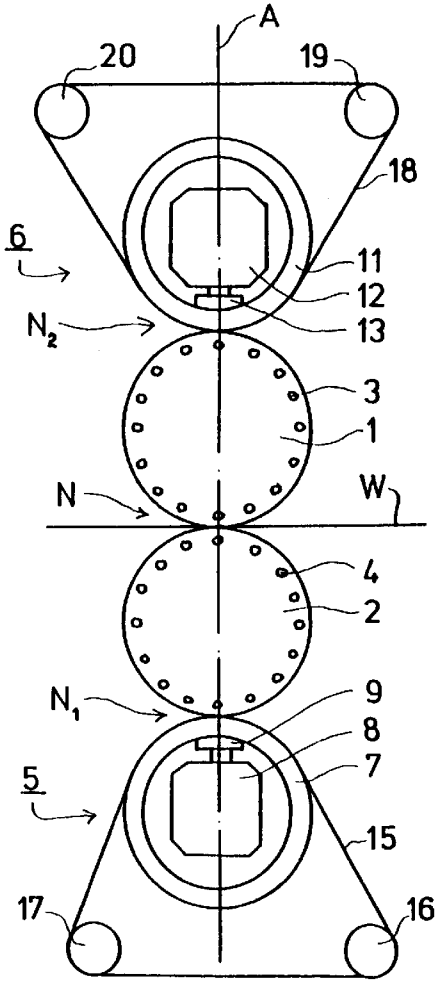
FIG. 2A is an illustration corresponding to FIGS. 1A and 1B of an alternative embodiment of a calender in accordance with the invention.

FIG. 2A shows an embodiment alternative to the calender as shown in FIG. 1A. The solution of FIG. 2A differs from FIG. 1A in the respect that, in the exemplifying embodiment shown in FIG. 2A, a belt, felt or equivalent 15,18 which has been formed as an endless loop is passed around the variable-crown support rolls 5,6, which belt, felt or equivalent is separated from the faces of the variable-crown support rolls 5,6 by means of alignment and reversing rolls 16,17;19,20. Thus, the belt, felt or equivalent 15,18 runs through the auxiliary nip $N_1$,$N_2$, and the function of said belt, felt or equivalent is the same as that of the surface material 10,14 of the roll mantle as shown in FIG. 1A, i.e. the function is to prevent damage to the face of the heatable calender roll 1,2 by means of said belt, felt or equivalent. Thus, as the material of the belt, it is possible to use, for example, some suitable heat-resistant polymer material. In respect of its other properties and of its operation, the calender as shown in FIG. 2A is similar to that illustrated in FIG. 1A.

Similarly, FIG. 2B shows an embodiment alternative to the calender shown in FIG. 1B, so that in the solution of FIG. 2B one of the calender rolls 1,2 is provided with a support roll 5, around which a belt, felt or equivalent which has been formed as an endless loop is passed in a way similar to FIG. 2A, which belt, felt or equivalent is substituted for the surface material 10 of the roll mantle of the support roll in the embodiment as shown in FIG. 1B. Thus, also in FIG. 2B, the function of the belt, felt or equivalent 15 is to soften the auxiliary nip $N_1$ between the support roll 5 and the opposite calender roll 2 and to prevent damage to the face of the calender roll 2. Differing from the exemplifying embodiments shown in the figures, the calender can also be constructed so that one of the calender rolls 1,2 is provided with a support roll provided with a surface material 10,14 softer than the calender rolls, as is shown in FIGS. 1A and 1B, whereas, similarly, the other one of the calender rolls is provided with a support roll as shown in FIGS. 2A and 2B, around which support roll an endless belt, felt or equivalent 15,18 is arranged running.

Figure 3B:
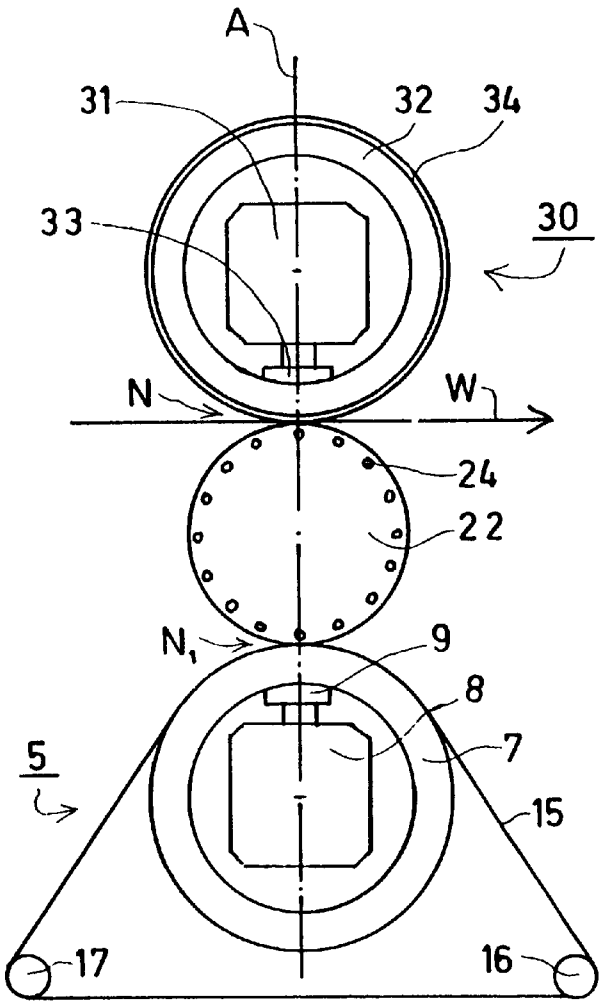
FIGS. 3A, 3B and 3C are illustrations corresponding to the above figures of alternative embodiments of a soft-nip calender.
Figure 3A:
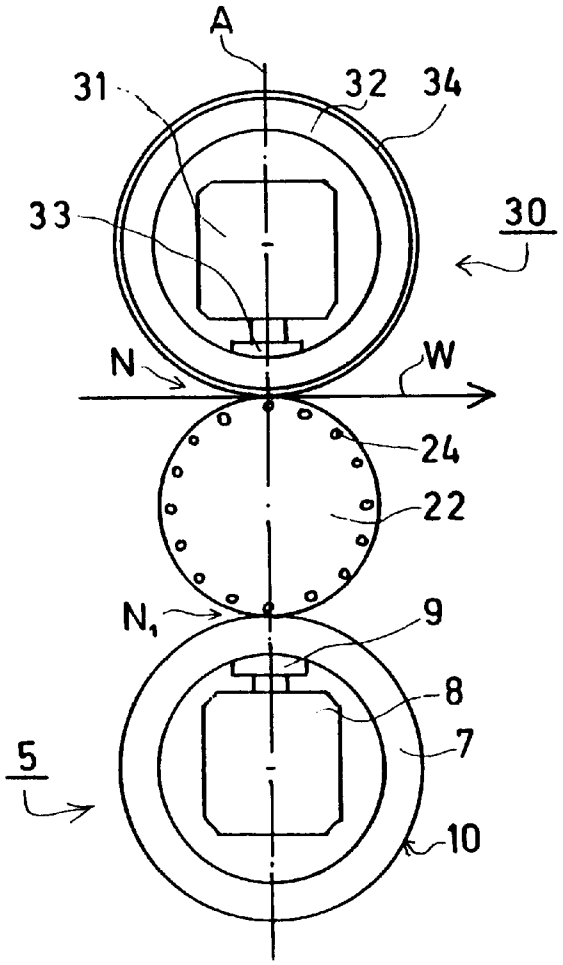
Figure 3C:
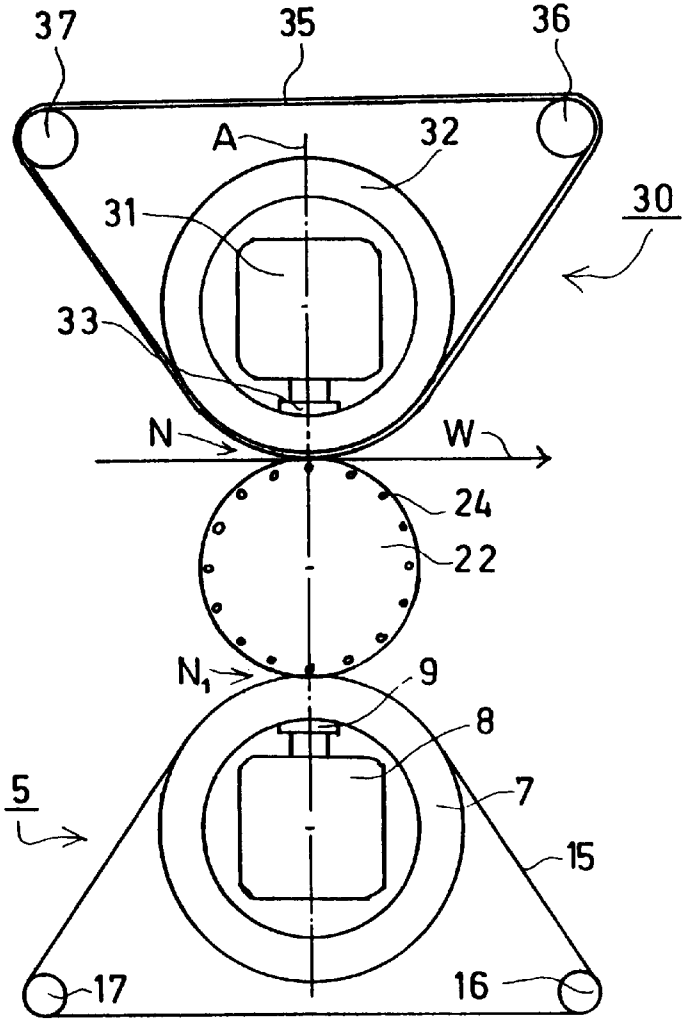

Thus, FIGS. 3A, 3B and 3C show alternative exemplifying embodiments of a calender in accordance with the present invention, in which calender the calendering nip N is a soft nip. In the illustration in FIG. 3A, the portion placed below the web W and the calendering nip N is similar to that described in relation to FIG. 1A, so that the heatable hard-faced calender roll 22, which is provided with bores 24 formed in the vicinity of the roll face, is provided with a support roll 5 which supports said heatable calender roll 22, so that the support roll 5 forms an auxiliary nip $N_1$ with the heatable calender roll 22. The support roll 5 is a hydraulically loaded variable-crown roll, which comprises a tubular roll mantle 7 that is arranged revolving on the roll axle 8. In the axle 8 of the support roll, hydraulic loading means 9 are fitted, which are supported by the effect of a pressure medium against the inner face of the roll mantle 7 so that, by means of said support roll 5, the heatable calender roll 22 can be loaded towards the calendering nip N adjustably. The other one of the rolls 30 that form the calendering nip N is a variable-crown roll which comprises a stationary roll axle 31, on which the roll mantle 32 is fitted revolving, which roll mantle is loaded towards the calendering nip N by means of loading elements 33 fitted in the roll axle 31. Said variable-crown roll 30 is provided with a soft coating 34, so that the calendering nip N is a soft nip. The rolls have been arranged in such a way in relation to one another that the calendering nip N and the auxiliary nip $N_1$ have a common nip plane A.

FIG. 3B is in the other respects identical with the illustration in FIG. 3A with the exception that, in the exemplifying embodiment shown in FIG. 3B, a belt, felt or equivalent 15 that has been formed as an endless loop has been passed around the variable-crown support roll 5, which belt, felt or equivalent 15 has been taken apart from the face of the variable-crown support roll 5 by means of alignment and reversing rolls 16,17. Thus, the belt, felt or equivalent 15 runs through the auxiliary nip $N_1$, and the function of said belt, felt or equivalent was already described and explained, for example, in connection with the descriptions of FIGS. 1A . . . 2B.

On the other hand, FIG. 3C is largely similar to the illustration in FIG. 3B, however, differing from that in respect of the construction of the soft-faced calender roll 30. While, in the illustrations in FIGS. 3A and 3B, the soft-faced variable-crown calender roll 30 was provided with a soft coating 34 fixed to the face of the roll mantle 32, in the exemplifying embodiment of FIG. 3C the soft surface layer has been arranged by means of a belt or band 35 formed on the variable-crown calender roll 30 as an endless loop, said belt or band being arranged to run through the calendering nip N. The run of the belt 35 is arranged to be guided by the reversing rolls 36,37, by whose means the soft belt 35 has been taken apart from the face of the variable-crown calender roll 30. In the other respects, the illustration in FIG. 3C is similar, for example, to that described in relation to FIG. 3B.

Above, the invention has been described by way of example with reference to the figures in the accompanying drawing. The invention is, however, not confined to the exemplifying embodiments illustrated in the figures only, but different embodiments of the invention may show variation within the scope of the inventive idea defined in the accompanying patent claims.

We claim:

1. A calender for calendering a web, comprising a first calendering member comprising a first hard-faced, heatable calender roll, first heating means for heating said first calender roll, a second calendering member arranged to define a first calendering nip with said first calender roll through which the web is passed to be calendered, said second calendering member comprising a roll having a soft surface layer such that said first nip is a soft nip and loading means arranged in said roll having a soft surface layer for applying a load toward said first nip, and a first variable-crown support member arranged to define a second nip with said first calender roll, said first variable-crown member comprising loading means for loading said first calender roll in a direction toward said first nip to prevent deflection of said first nip, said first calender roll and said second calendering member.

2. A calender for calendering a web, comprising a first calendering member comprising a first hard-faced, heatable calender roll, first heating means for heating said first calender roll, a second calendering member arranged to define a first calendering nip with said first calender roll through which the web is passed to be calendered, said second calendering member comprising a second calender roll, an endless belt or band arranged to run over said second calender roll and through said first nip, and reversing rolls arranged in a loop of said endless band or belt and over which said belt or band is arranged to run, and a first variable-crown support member arranged to define a second nip with said first calender roll, said first variable-crown member comprising loading means for loading said first calender roll in a direction toward said first nip to prevent deflection of said first nip, said first calender roll and said second calendering member.

3. The calender of claim 2, wherein said belt or band is made of a heat-resistant polymer material.

4. A calender for calendering a web, comprising a first calendering member comprising a first hard-faced, heatable calender roll, heating means for heating said first calender roll, a second calendering member arranged to define a first calendering nip with said first calender roll through which the web is passed to be calendered, and a first variable-crown support member arranged to define a second nip with said first calender roll, said first variable-crown member comprising first loading means for loading said first calender roll in a direction toward said first nip to prevent deflection of said first nip, said first calender roll and said second calendering member, said first variable-crown member comprising a first variable-crown roll in which said first loading means are arranged, an endless belt or felt of a heat-resistant material, and alignment and reversing rolls for guiding said belt or felt in a loop around said first variable-crown roll and through said second nip such that damage to an outer face of said first calender roll is prevented.

5. A calender for calendering a web, comprising a first calendering member comprising a first hard-faced, heatable calender roll, first heating means for heating said first calender roll, a second calendering member arranged to define a first calendering nip with said first calender roll through which the web is passed to be calendered, said second calendering member comprising a second hard-faced, heatable calender roll, second heating means for heating said second calender roll, a first variable-crown support member arranged to define a second nip with said first calender roll, said first variable-crown member comprising first loading means for loading said first calender roll in a direction toward said first nip to prevent deflection of said first nip, said first calender roll and said second calendering member, said first variable-crown member comprising a first variable-crown roll in said first loading means are arranged, a first endless belt or felt of a heat-resistant material, a first set of alignment and reversing rolls for guiding said first belt or felt in a loop around said first variable-crown roll and through said second nip such that damage to an outer face of said first calender roll is prevented, and a second variable-crown support member arranged to define a third nip with said second calender roll, said second variable-crown member comprising second loading means for loading said second calender roll in a direction toward said first nip to prevent deflection of said first nip and said first and second calender rolls, said second variable-crown member comprising a second variable-crown roll in which said second loading means are arranged, a second endless belt or felt of a heat-resistant material, and a second set of alignment and reversing rolls for guiding said second belt or felt in a loop around said second variable-crown roll and through said third nip such that damage to an outer face of said second calender roll is prevented.

6. A calender for calendering a web, comprising a first calendering member comprising a first hard-faced, heatable calender roll, first heating means for heating said first calender roll, a second calendering member arranged to define a first calendering nip with said first calender roll through which the web is passed to be calendered, said second calendering member comprising a second hard-faced, heatable calender roll, second heating means for heating said second calender roll, a first variable-crown support member arranged to define a second nip with said first calender roll, said first variable-crown member comprising first loading means for loading said first calender roll in a direction toward said first nip to prevent deflection of said first nip, said first calender roll and said second calendering member, said first variable-crown member comprising a first variable-crown roll having a roll mantle having a heat-resistant surface material softer than the material of said first calender roll such that damage to an outer face of said first calender roll is prevented, and a second variable-crown support member arranged to define a third nip with said second calender roll, said second variable-crown member comprising second loading means for loading said second calender roll in a direction toward said first nip to prevent deflection of said first nip and said first and second calender rolls, said second variable-crown member comprising a second variable-crown roll, an endless belt or felt of a heat-resistant material and alignment, and reversing rolls for guiding said belt or felt in a loop around said second variable-crown roll and through said third nip such that damage to an outer face of said second calender roll is prevented.

* * * * *